US005923353A

United States Patent [19]

Boyd et al.

[11] Patent Number: 5,923,353

[45] Date of Patent: Jul. 13, 1999

[54] FAIL-SAFE, BACKUP VALVE IN A PRESSURIZED INK DELIVERY APPARATUS

[75] Inventors: Melissa D. Boyd; Norman E. Pawlowski, Jr., both of Corvallis, Oreg.

[73] Assignee: Hewlett-Packard Company, Palo Alto, Calif.

[21] Appl. No.: 08/718,615

[22] Filed: Sep. 23, 1996

[51] Int. Cl.[6] ..... B41J 2/175

[52] U.S. Cl. ..... 347/85

[58] Field of Search ..... 347/84, 86, 85, 347/87; 137/494, 907

[56] References Cited

U.S. PATENT DOCUMENTS 5,719,609 2/1998 Hauck et al. ..... 347/85

5,751,319 5/1998 Robertson et al. ..... 347/85

5,835,111 11/1998 Balazer ..... 347/85

*Primary Examiner*—N. Le

*Assistant Examiner*—Judy Nguyen

[57] ABSTRACT

A fail-safe, backup valve for an ink-jet print head in a pressurized ink delivery system. The backup valve is in series with and is actuated by a back pressure regulator if the operating pressure of the print head approaches atmospheric pressure during operation.

9 Claims, 3 Drawing Sheets

FAIL-SAFE, BACKUP VALVE IN A PRESSURIZED INK DELIVERY APPARATUS

FIELD OF INVENTION

The present invention generally relates to ink-jet printing and, more particularly, to an apparatus for delivering ink to print heads.

BACKGROUND OF THE INVENTION

The art of ink-jet technology is relatively well developed. Commercial products such as computer printers, graphics plotters, and facsimile machines employ ink-jet technology for producing printed media. Hewlett-Packard's contributions to this technology are described, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992), and Vol. 45, No.1 (February 1944).

Generally, an ink-jet image is formed when a precise pattern of dots is ejected from a drop generating device known as a "print head" onto a printing medium. The typical ink-jet print head has an array of precisely formed nozzles attached to a thermal ink-jet print head substrate. The substrate incorporates an array of firing chambers that receive liquid ink (colorant dissolved or dispersed in a solvent) from an ink reservoir. Each chamber has a thin-film resistor, known as a "firing resistor", located opposite each nozzle so ink can collect between the firing resistor and the nozzle. When electric printing pulses heat the thermal ink-jet firing resistor, a small volume of ink adjacent the firing resistor is heated, vaporizing a bubble of ink, and thereby ejecting a drop of ink from the print head. The droplets strike the printing medium and then dry to form "dots" that, when viewed together, form the printed image.

In general, the ink within a print head has an operating pressure chosen between two limiting conditions. The operating pressure must be sufficiently low so that during operation the ink remains within the print head and does not run freely out of the firing chambers and the nozzles. On the other hand, the operating pressure of the print head must be sufficiently high so when the firing resistor is heated, the vaporized bubble of ink can over come the pressure and eject a droplet of ink from the firing chamber. Most print heads today operate at a slight vacuum, typically in a pressure range of between about −2" (minus two inches) of water to about −30" (minus thirty inches) of water.

In the future ink-jet print heads may be located in printers having pressurized ink supplies. A pressurized ink supply enables ink to be supplied to the print head at higher flow rates than non-pressurized systems. The ink in such a system is pressurized in a reservoir to a supply pressure of between about −5" (minus five inches) of water to about +80" (plus eighty inches) of water and is delivered to the print head using either a tube or a conduit. A back pressure regulator is normally located near the print head to reduce the supply pressure of the ink down to the operating pressure of the print head.

Needless to say, such pressurized ink supply systems that operate above atmospheric pressure have the potential for developing leaks that may result in ink freely running out of the print head or its housing. Thus, there is a need for a fail/safe valve to prevent such incidents.

It should be appreciated that there was no need to solve this problem in previous ink delivery systems because such systems operated on capillary pressure and at a slight vacuum. Further, these unpressurized systems did not incorporate a back pressure regulator that could fail to shut during operation and that could over pressurize the print head to the point of spraying ink.

SUMMARY OF THE INVENTION

Briefly and in general terms, an apparatus according to the present invention includes a print head having an operating pressure of less than atmospheric pressure, a source of ink having a supply pressure of greater than the print head operating pressure, and a back pressure regulator for reducing the supply pressure of the ink down to the print head operating pressure using a lever arm actuated by changes in the operating pressure. The invention further includes a conduit for the ink connecting the ink source, the back pressure regulator, and the print head; and a backup valve connected to the conduit. The backup valve has an open position and a shut position with respect to the conduit. If the operating pressure of the print head approaches atmospheric pressure, the lever arm of the back pressure regulator actuates the backup valve to the conduit shut position.

One advantage of the present invention is redundant sealing of the pressurized ink in the ink delivery conduit. This is also called "two-valve" protection. A conventional back pressure regulator incorporates a throttling valve which can block ink flow. In addition, here there is also a backup valve that will block the flow of pressurized ink if the throttling valve fails to shut.

Other aspects and advantages of the invention will become apparent from the following detailed description, taken in conjunction with the accompanying drawings, illustrating by way of example the principles of the invention.

BRIEF DESCRIPTION OF THE DRAWINGS

FIG. 1 illustrates the pressure regulator in the shut position and the backup valve in the open position.

FIG. 2 illustrates the pressure regulator in the open position.

FIG. 3 illustrates the back pressure regulator and the backup valve in the shut position.

FIG. 4 illustrates the pressure regulator in the shut position and the backup valve in the open position.

FIG. 5 illustrates the pressure regulator in the open position.

FIG. 6 illustrates the back pressure regulator and the backup valve in the shut position.

DESCRIPTION OF THE PREFERRED EMBODIMENTS

Figure 1:
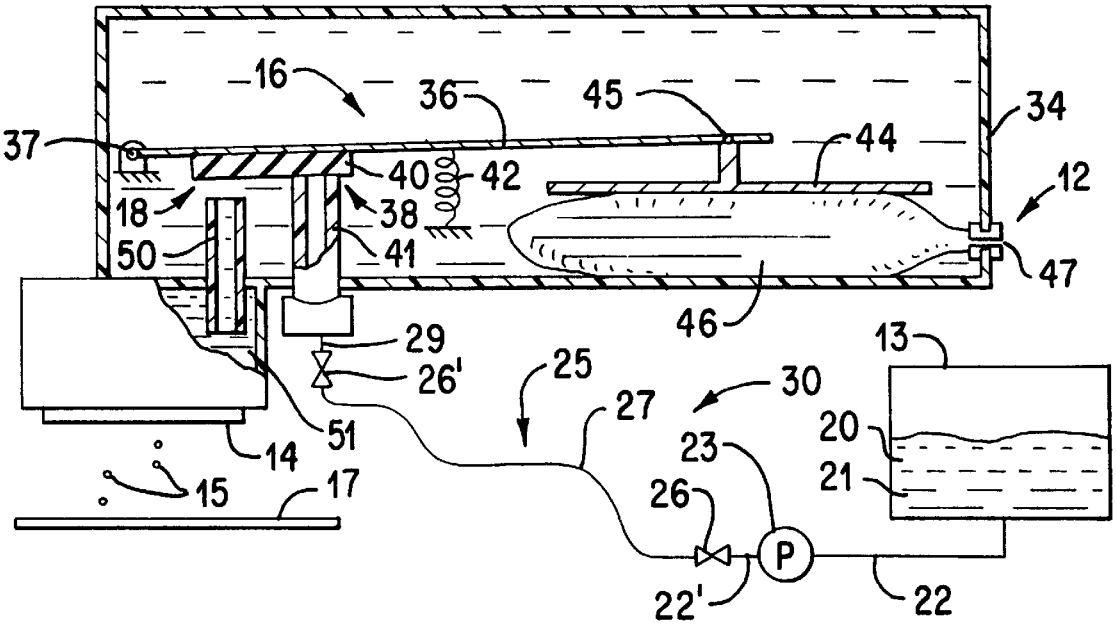
FIG. 1 is a diagrammatic, side elevational view, partially in section and partially cut away, of a backup valve in a pressurized ink delivery apparatus for a print head embodying the principles of the invention.

As shown in the drawings for the purposes of illustration, the invention is embodied in an ink supply apparatus 12, FIG. 1 that delivers ink under pressure from an ink source 13 to a print head 14. The print head ejects droplets 15 of ink onto a printing medium 17 such as paper. A back pressure regulator 16 located near the print head 14 actuates a backup valve 18 to prevent ink from running out of the print head 14.

Referring to FIG. 1, reference numeral 13 indicates a source of ink. The source of ink in this embodiment is an ink reservoir 20 containing liquid ink 21. The ink reservoir 20 is connected to a pump 23 by tubing 22. The pump is of conventional construction and pressurizes the ink to a supply pressure of between about −5" and about +80" of water. The pump 23 is connected to a fluid interconnect 25 by tubing 22'. The fluid interconnect includes two valves 26, 26' and connecting tubing 27 and is of conventional construction. The fluid interconnect allows the engagement and disengagement of the ink reservoir 20 and the pump 23 from the back pressure regulator 16 without allowing either ink to flow out of the system or air to enter the tubing. The fluid interconnect 25 is connected to the back pressure regulator 16 by tubing 29 so that the tubing 22, 22', 27, and 29 forms an ink delivery conduit 30 to the back pressure regulator 16.

It should be appreciated that the pressurized ink supply 12 can take many forms including a spring actuated diaphragm, an air pressurized reservoir, and a gravity driven supply. The only limitation on the pressurized ink supply is that it must have a supply pressure that is greater than the operating pressure of the print head 14.

Referring to FIG. 1, the back pressure regulator 16 is contained within a fluid tight housing 34. The back pressure regulator includes a lever arm 36 that pivots about a stationary fulcrum 37. The lever arm opens and shuts a throttling valve 38 that includes a valve seat 40 on the lever arm and an inlet orifice 41 to the housing 34. The ink delivery conduit 30 is connected to the throttling valve 38 by the tubing 29. The throttling valve reduces the pressure of the ink from the supply pressure in the ink delivery conduit 30 down to the operating pressure of the print head 14. The valve seat can be fabricated from any resilient, elastomeric material that does not chemically react with the ink. The inlet orifice 41 is stationary and is rigidly attached to the housing 34. This orifice can be a hollow tube or conduit with an opening that can be both partially and fully blocked by the valve seat 40.

In FIG. 1 the lever arm 36 is urged around the fulcrum 37 in a clockwise direction by a spring 42. The spring 42 thus tends to shut the throttling valve 38 of the back pressure regulator 16.

Referring to FIG. 1, the back pressure regulator 16 further includes a tracking arm 44 operationally connected to the lever arm 36 by a mechanical coupling 45. The tracking arm mechanically engages the full surface of an inflatable/deflatable flexible bag 46 so that any change in the volume of the bag is translated into rotation of the lever arm 36 around the fulcrum 37 and so that all forces developed by the bag 46 are transferred to the lever arm 36. The bag can be fabricated from any thin plastic film that does not chemically react with the ink in the housing 34. The bag is vented to atmosphere through a vent 47 in the housing 34 so that the interior of the bag is continuously maintained at atmospheric pressure. The exterior of the bag is subject to the pressure of the ink in the housing 34 which is controlled by the throttling valve 38 and the print head 14. The bag is normally in a slightly expanded state because the pressure in the housing is maintained at a slight vacuum.

Figure 3:
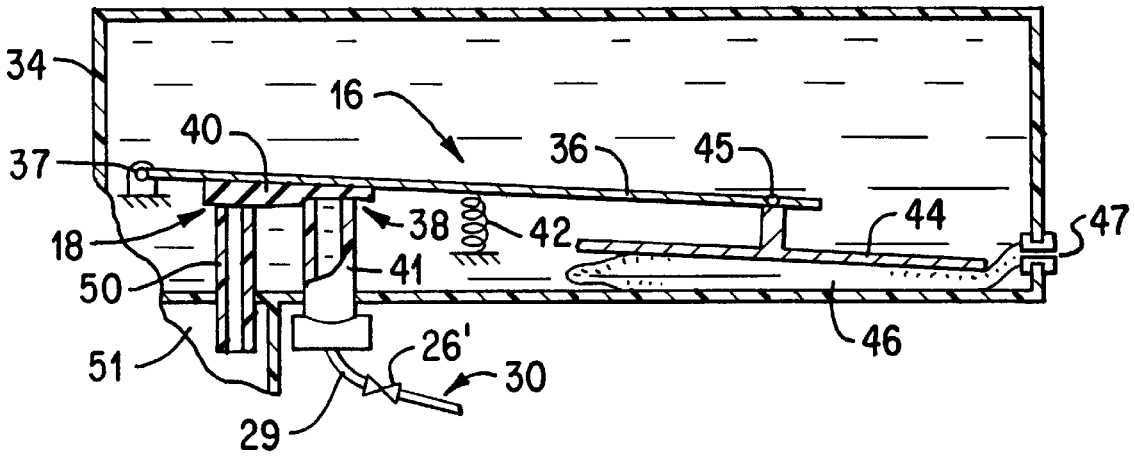
FIG. 3 is a side elevational view, partially in section and partially cut away, of the apparatus of FIG. 1.

In FIG. 1, the back up valve 18 includes an exit orifice 50 in the bottom wall of the housing 34 proximate to the throttling valve 38 described above. The exit orifice is stationary and can be fabricated from a tube that communicates with an intermediate chamber 51. The intermediate chamber in turn communicates with the print head 14 so that ink can flow through the ink delivery conduit 30, the back pressure regulator 38, the back up valve 18, the intermediate chamber 51, and the print head 14. The exit orifice 50 is positioned so that the valve seat 40 can block the opening of the exit orifice by further clockwise motion of the lever arm 36 about the fulcrum 37 after the throttling valve 38 is blocked. Referring to FIG. 3, this further clockwise motion is obtained by the collapse of the bag 46 and the additional deformation of the valve seat 40 by the inlet orifice 41. In FIG. 3 both the throttling valve 38 and the back up valve 18 are shut.

The initial condition of the back pressure regulator 16 is illustrated in FIG. 1. The throttling valve 38 is shut by the engagement of the valve seat 40 and the inlet orifice 41. Spring 42 urges the lever arm 36 clockwise about the fulcrum 37 toward the valve shut position. The pressure of the ink in the ink delivery conduit 30 is maintained at the supply pressure by the pump 23. The interior of the bag 46 is referenced to atmospheric pressure through the vent 47 in the housing 34. The bag 46 is slightly inflated, and the pressure of the ink in the housing 34 and the intermediate chamber 51 is maintained at a slight vacuum.

Figure 2:
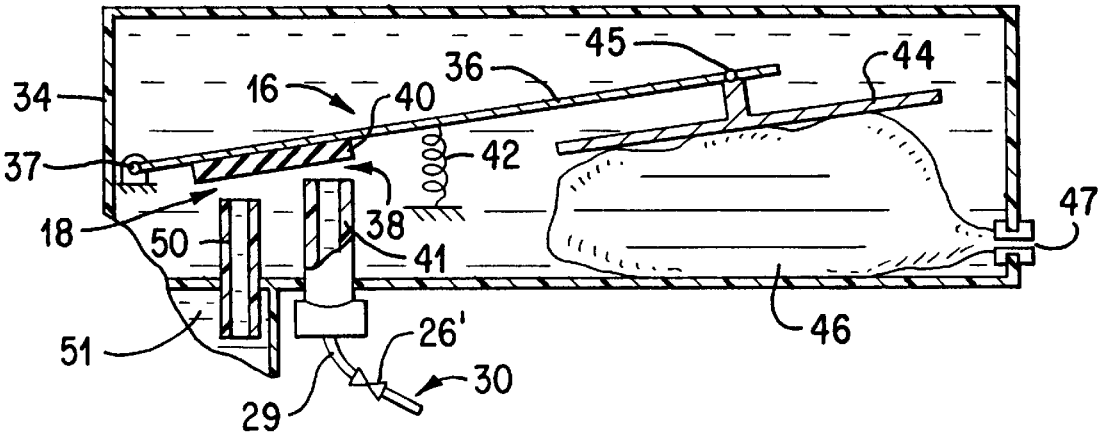
FIG. 2 is a side elevational view, partially in section and partially cut away, of the apparatus of FIG. 1.

Referring to FIGS. 1 and 2, when the print head 14 begins printing, that is by ejecting droplets of ink 15 onto the paper 17, the pressure of the ink in the intermediate chamber 51 drops slightly. This drop in pressure is communicated to the ink in the housing 34 through the exit orifice 50. The ink, in effect, is being pumped out of the intermediate chamber 51 and the housing 34. Since the pressure in the inside of the bag 46 is referenced to atmospheric pressure, such a drop in pressure of the ink in the housing 46 causes the bag to expand as illustrated FIG. 2. Expansion of the bag, in turn, pivots the lever arm 36 counter-clockwise about the fulcrum 37 and opens the throttling valve 38 of the pressure regulator 16. The spring 42 urges the lever arm clockwise so that the tracking arm 44 and the lever arm 36 follow the change in volume of the bag 46.

Opening the throttling valve 38, FIG. 2, allows ink to enter the housing 34 from the delivery conduit 30. The pump 23 maintains the pressure of the ink in the delivery conduit at the supply pressure. The back pressure regulator 16 reduces the supply pressure of the ink in the delivery conduit down to the operating pressure of the print head. The pressure of the ink in the housing 34 thereby raises back to the normal operating pressure of the print head. As the pressure of the ink in the housing approaches the operating pressure, the bag 46 deflates and the condition illustrated in FIG. 1 is restored.

In summary, the throttling valve 38 cycles open and shut as illustrated in FIGS. 1 and 2 as the pressure of the ink in the housing 34 decreases and increases. The throttling valve 38 is actuated by the expansion and contraction of the bag 46. The back up valve 18 remains open in all cases described above.

There are several abnormal situations in which the pressure of the ink in the housing 34, which is normally at a slight vacuum, can approach atmospheric pressure or go even higher. This has the potential for the ink to run freely out of the print head 14 or the housing 34 and cause a catastrophic mess. First, the throttling valve 38 could fail to shut. Debris could block the intake orifice 41 from engaging the valve seat 40. Also, the lever arm 36 could seize about the fulcrum 37. The housing 34 would then become over pressurized by the ink at the supply pressure in the ink delivery conduit 30. Secondly, a crack or hole in the housing 34 could release the vacuum in the system. Thirdly, the bag 46 could develop a hole and the differential pressure between the inside and the outside of the bag could go to zero.

If any of the failure conditions occur with the throttling valve 38, the backup valve 18 closes thereby preventing further damage or use of the print head 14. This closure also gives a clear signal to the user that the print cartridge has failed or is in poor health and needs to be replaced.

FIG. 3 illustrates the abnormal condition when the pressure of the ink in the housing has approached atmospheric pressure or gone even higher. In other words, the differential pressure of the ink between the inside and the outside of the bag 46 has gone to zero or less.

To reach the condition illustrated in FIG. 3, the bag 46 first began to collapse or deflate beyond the condition illustrated in FIG. 1. The pressure in the housing 34 went from a slight vacuum up toward atmospheric pressure. The throttling valve 38 either shut or was urged shut by the spring 42 as illustrated in FIG. 3. As the pressure in the housing continued to approach atmospheric pressure, the lever arm 36 rotated further clockwise and deformed the elastomeric valve seat 40. The clockwise rotation continued until either the bag 46 stopped collapsing or the back up valve 18 was shut by the valve seat 40. In any case, the back up valve 18 shut and prevented the ink at supply pressure from the supply conduit 30 from spewing out of the print head 14.

It should be noted that the throttling valve 38 is shut first followed by the back up valve 18, that the two valves are in series and that they share a common valve seat 40. As illustrated in FIG. 3 the ink delivery conduit 30 is blocked by the throttling valve 38 as well as the back up valve 18. This is redundant sealing. Further, the valve seat 40 is fabricated from a material that allows sufficient elastic deformation to shut both valves although they are spaced apart from the valve seat 40 at different distances. It is this difference in spacing that permits the throttling valve 38 to cycle open and shut as illustrated in FIGS. 1 and 2 without shutting the back up valve 18.

Figure 4:
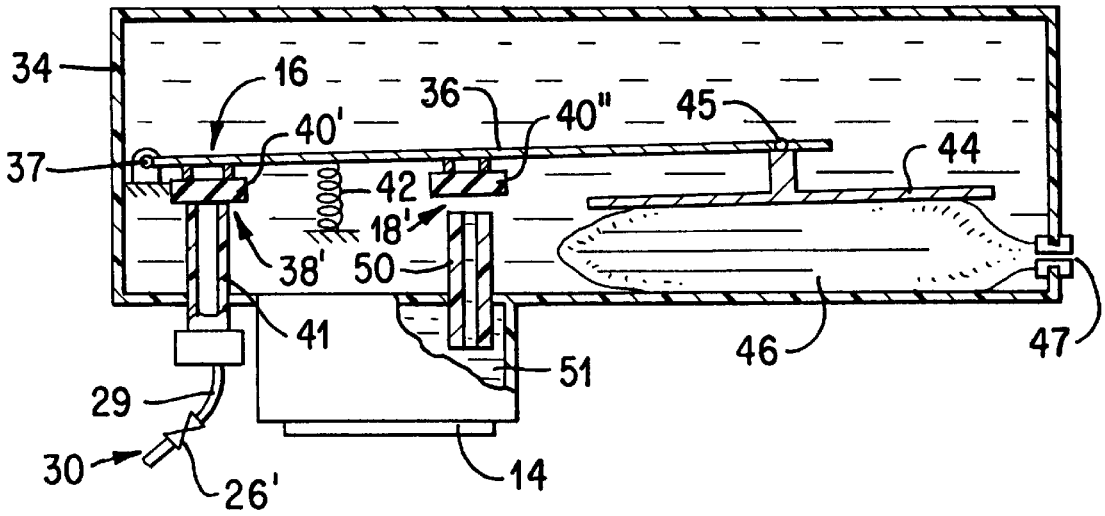
FIG. 4 is a side elevational view, partially in section and partially cut away, of an alternative embodiment of the present invention.
Figure 5:
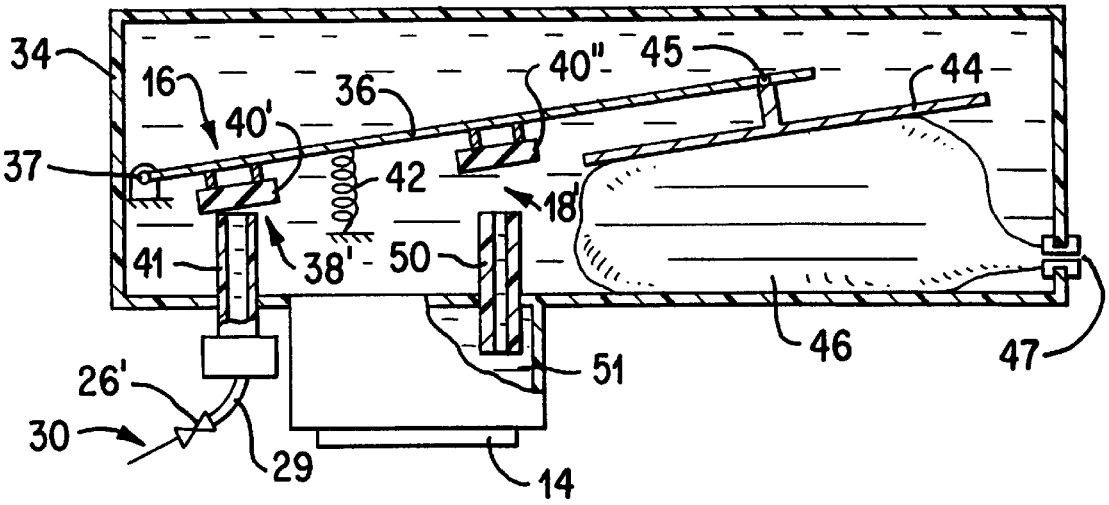
FIG. 5 is a side elevational view, partially in section and partially cut away, of the apparatus of FIG. 4.
Figure 6:
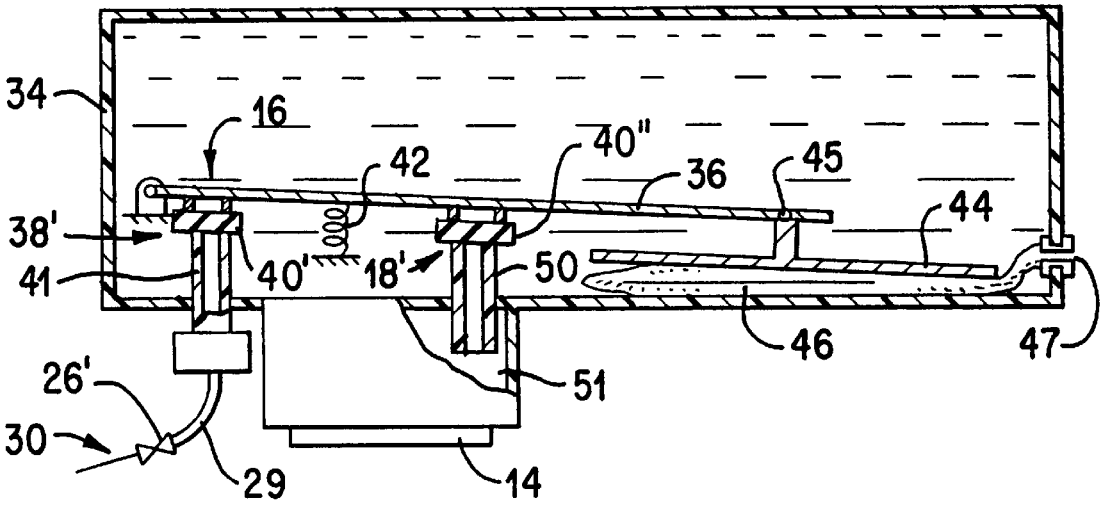
FIG. 6 is a side elevational view, partially in section and partially cut away, of the apparatus of FIG. 4.

In FIGS. 4, 5, and 6 like-numbered parts have the same construction and function as the parts described above and the parts designated by primed numbers have essentially the same construction and function as those unprimed parts described above. For brevity the common descriptions and functions will not be repeated.

In the alternative embodiment illustrated in FIGS. 4, 5, and 6 the throttling valve 38' is located proximate to the fulcrum 37 and the back up valve 18' is distally located from the fulcrum 37. Further, there are two, separate, spaced apart, valve seats 40' and 40" that are mounted on the lever arm 36. Each valve seat engages its respective orifice depending on the pressure of the ink in the housing 34 as the pressure approaches or exceeds atmospheric pressure. In this embodiment like the one described above, the valve seat 40' is spaced apart from the inlet orifice 41 by a distance different from the distance between the valve seat 40" and the exit orifice 50 so that the throttling valve 38' of the back pressure regulator 16 can cycle open and shut before the pressure in the housing 34 rises sufficiently so that the back up valve 18' shuts. The cycling open and shut of the throttling valve 38' is illustrated in FIGS. 4 and 5. The shutting of both the throttling valve 38' and the back up valve 18' is illustrated in FIG. 6.

Although specific embodiments of the invention have been described and illustrated, the invention is not to be limited to the specific forms or arrangement of parts so described and illustrated. For example, although the specific embodiments described herein are directed to ink-jet print heads, the invention can be used with both piezoelectric and continuous flow print heads. Thus, the invention is limited only by the claims.

We claim:

1. An ink supply apparatus providing pressurized ink delivery to a print head, the print head ejecting droplets of ink on to a printing medium to form an image, comprising:

the print head having an operating pressure of less than atmospheric pressure which changes with the ejection of droplets of ink;

a source of ink having a supply pressure of greater than said print head operating pressure; and a back pressure regulator in fluid communication with said source of ink and the print head, said back pressure regulator including:

a lever arm, said lever arm rotating about a fulcrum in response to said operating pressure of said print head, a throttling valve having an open position and a shut position, mechanically coupled to said lever arm, and fluidically coupled to said source of ink, said throttling valve including a stationary throttling valve orifice and a throttling valve seat that is disposed on said lever arm, said throttling valve seat urged against said throttling valve orifice by said lever arm to place said throttling valve in said shut position when said operating pressure of the print head approaches or exceeds atmospheric pressure, and a backup valve having an open position and a shut position, mechanically coupled to said lever arm, and fluidically disposed between said throttling valve and the print head, said backup valve including a stationary backup valve orifice and a backup valve seat that is disposed on said lever arm, said backup valve seat urged against said backup valve orifice by said lever arm to place said backup valve in said shut position when said throttling valve is in said shut position and said operating pressure of the print head further approaches or exceeds atmospheric pressure.

2. The apparatus of claim 1 further comprising an ink delivery conduit coupling said source of ink to said stationary throttling valve orifice of said back pressure regulator.

3. The apparatus of claim 1 wherein said lever arm includes said backup valve seat common to both said stationary backup valve orifice and said throttling valve orifice.

4. The apparatus of claim 1 further comprising a housing said housing encompassing an ink reservoir fluidically coupled to said source of ink by way of said throttling valve and fluidically coupled to said print head by way of said backup valve.

5. The apparatus of claim 1 wherein said throttling valve seat is spaced apart from said throttling valve orifice a distance less than said backup valve seat is spaced apart from said backup valve orifice so that as said operating pressure of the print head approaches atmospheric pressure, said lever arm places said throttling valve in said shut position before said lever arm places said back up valve in said shut position.

6. The apparatus of claim 1 wherein said backup valve seat is positioned closer to said fulcrum than said throttling valve seat.

7. The apparatus of claim 1 wherein said backup valve seat is positioned further from said fulcrum than said throttling valve seat.

8. The apparatus of claim 1 wherein said throttling valve is in said open position in a range of operating pressures of between about −3 ½" of water and about −15" of water and said backup valve is in said open position in a range of operating pressures of about −1 ½" of water or lower and shut in a range of operating pressures of about −1" of water or higher.

9. The apparatus of claim 1 further comprising a housing which contains said back pressure regulator, said throttling valve orifice being disposed within said housing, said backup valve orifice being disposed within said housing, and wherein said throttling valve orifice and said backup valve orifice are disposed in a range of about 0.005" (five thousandths of an inch) and about 0.030" (thirty thousandths of an inch) relative to each other.

* * * * *